United States Patent [19]

Ishifuro et al.

[11] Patent Number: 4,831,225

[45] Date of Patent: May 16, 1989

[54] MICROWAVE OVEN/CONVECTION OVEN HAVING MEANS FOR CONTROLLING VENTILATION OF THE COOKING CHAMBER

[75] Inventors: Kathumi Ishifuro, Yao; Kengo Hirata, Nara, both of Japan

[73] Assignee: Sharp Kabushiki Kaisha, Osaka, Japan

[21] Appl. No.: 136,285

[22] Filed: Dec. 22, 1987

[30] Foreign Application Priority Data

Dec. 27, 1986 [JP] Japan ..... 61-200734[U]

[51] Int. Cl.[4] ..... H05B 6/64

[52] U.S. Cl. ..... 219/10.55 B; 219/10.55 R; 219/400; 126/21 A

[58] Field of Search ..... 219/10.55 B, 10.55 R, 219/10.55 E, 400; 126/21 R, 21 A

[56] References Cited

U.S. PATENT DOCUMENTS

| | | | |
|---|---|---|---|
| 3,337,147 | 6/1965 | Soong et al. . | |
| 3,875,361 | 4/1975 | Fukui et al. | 219/10.55 B |
| 4,369,347 | 1/1983 | Shin | 219/10.55 B |
| 4,450,344 | 5/1984 | Sakoda et al. | 219/10.55 B X |
| 4,608,474 | 8/1986 | Kohka | 219/10.55 R |
| 4,635,610 | 1/1987 | Nakanishi | 219/10.55 B |
| 4,705,928 | 11/1987 | Nakanishi | 219/10.55 B |

FOREIGN PATENT DOCUMENTS

| | | |
|---|---|---|
| 3337147 | 4/1985 | Fed. Rep. of Germany . |
| 2540976 | 8/1984 | France . |
| 2137859 | 10/1984 | United Kingdom . |

OTHER PUBLICATIONS

European Search Report dated May 31, 1988.

*Primary Examiner*—Philip H. Leung

*Attorney, Agent, or Firm*—Birch, Stewart, Kolasch & Birch

[57] ABSTRACT

A microwave oven having a heater cooking device, a damper operated by the heat in the cooking chamber to control ventilation to the cooking chamber, a blower for cooling the cooking chamber exterior and electric components such as a magnetron, and temperature sensor for detecting the cooking chamber internal temperature. The microwave oven is characterized by a control circuit which actuates the blower immediately when the cooking chamber internal temperature at the time of starting the heater cooking operation is the same as or higher than a specified value considered high enough to actuate the damper and which actuates the ventilator with a delay of a specified time when the cooking chamber internal temperature is lower than the specified value.

5 Claims, 3 Drawing Sheets

MICROWAVE OVEN/CONVECTION OVEN HAVING MEANS FOR CONTROLLING VENTILATION OF THE COOKING CHAMBER

BACKGROUND OF THE INVENTION

Field of the Invention

The present invention relates to a microwave oven having a heater cooking function and is equipped with a damper which is actuated by the heat in the heating chamber to control ventilation to the heating chamber, or more specifically to an operation control system for a blower which cools the heating chamber exterior and electric components such as a magnetron.

A multi-functional microwave oven having heater cooking and microwave cooking functions is equipped with a damper that shuts off ventilation to the heating chamber to minimize heat loss during heater cooking operation and which allows ventilation to the heating chamber to release steam generating from cooked food to outside the heating chamber during a microwave heating operation.

For this application, the industry has recently proposed a damper that opens or closes due to the shape memory effect of a shape memory alloy. The damper using a shape memory alloy is disclosed in U.S. Pat. No. 4,608,474, issued on Aug. 26, by Kenichi Kohka, U.S. patent application Ser. No. 016,479, filed on Jan. 30, 1986, by Takeo Nakanishi, and U.S. patent application Ser. No. 484,460, filed on Apr. 13, 1983, by Masanobu Tanigawa.

However, any of the conventional commercialized dampers using a shape memory alloy utilizes a heater installed adjacent the shape memory alloy or the heat generated in the alloy itself when it is supplied with power, as a heat source for the alloy. The conventional damper of this type involves an additional electric heating device for actuating the damper, resulting in complicated construction and therefore high cost.

SUMMARY OF THE INVENTION

Accordingly, it is an object of the present invention to provide a microwave oven in which a damper operated by the heat in the heating chamber for controlling ventilation to the heating chamber is actuated quickly and accurately when heater cooking is started.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above object, according to an embodiment of the present invention, a microwave oven comprises a heater, a damper operated by the heat in the heating chamber for controlling ventilation to the heating chamber, a blower for cooling the heating chamber exterior and electric components such as a magnetron, temperature sensor means for detecting the heating chamber temperature, and control means which actuates the blower immediately when the heating chamber temperature at the time of starting heater cooking operation is the same as or higher than a specified value considered as sufficiently high for actuating the damper and which actuates the blower with the delay of a specified period when the heating chamber temperature is below the specified value.

When the heating chamber temperature at the time of starting heater cooking is below the specified value (For example, about 100° C.), the heating chamber is heated with the blower stopped for a specified period (For example, about 2 minutes) considered necessary to heat up the shape memory allow spring of the damper sufficiently high enough to be closed. This permits the heating chamber temperature to rise faster. Consequently, the shape memory alloy spring of the damper is heated rapidly, allowing the damper to close quickly. Then, the heating chamber temperature rises still faster because the damper has closed.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE INVENTION

An embodiment of the present invention will be described in detail with reference to the accompanying drawings.

Figure 1:
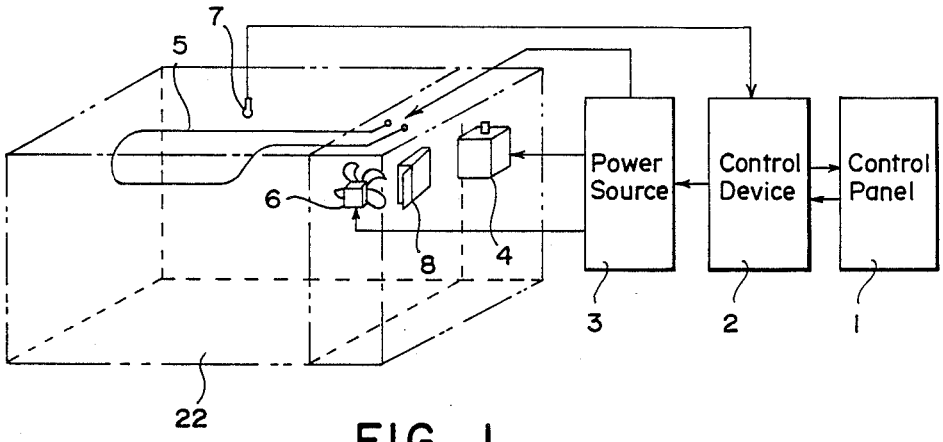
FIG. 1 is a structural drawing of the essential part of a microwave oven of the present invention.
Figure 2:
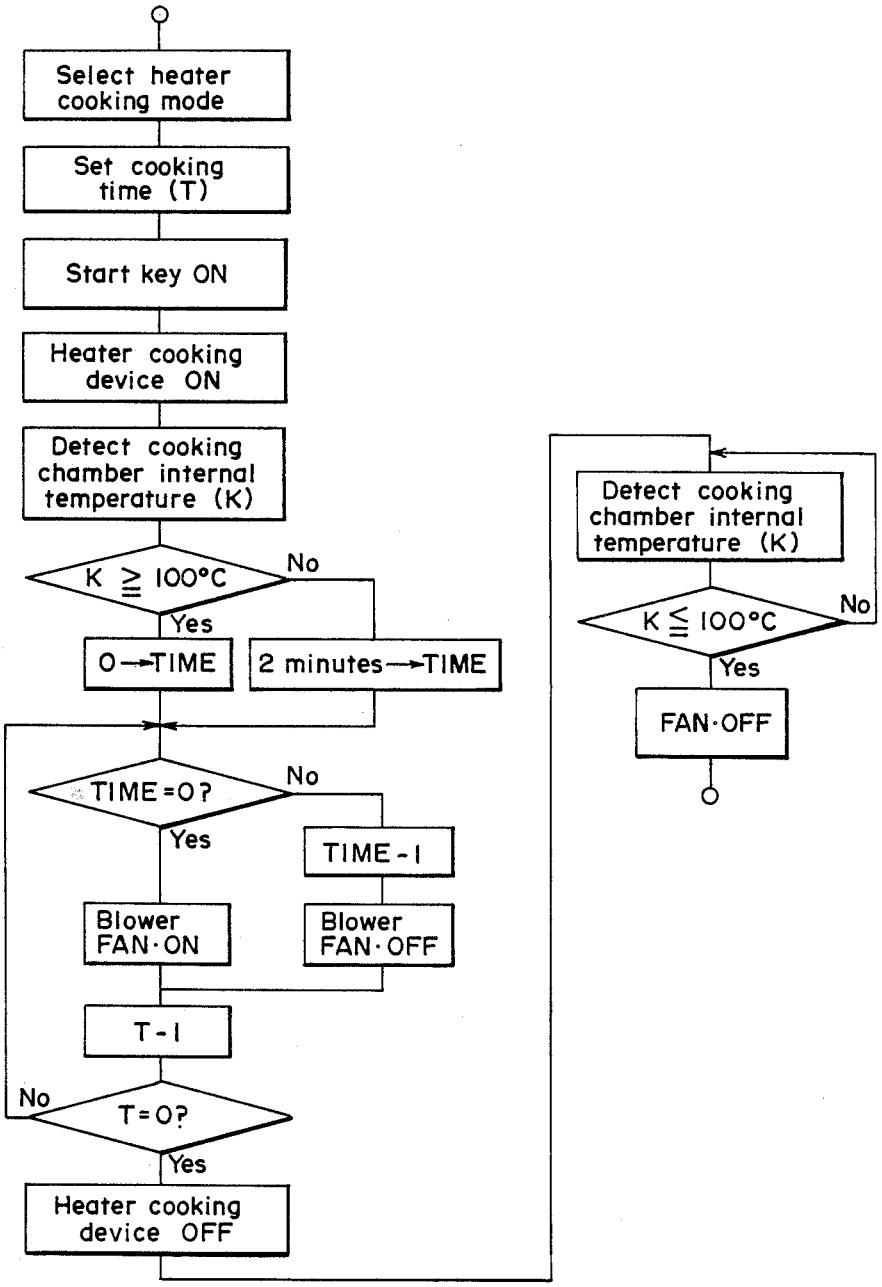
FIG. 2 is a flow chart for explaining the present invention.

FIG. 1 shows the construction of the essential part of a microwave oven of the present invention, and FIG. 2 is a flow chart for explaining the present invention.

Referring to FIG. 1, 1 is a control panel having thereon a key for selecting the desired cooking mode from various modes such as heater cooking and microwave cooking, various function keys, numeric keys for setting a cooking temperature and cooking time, a start key for starting a cooking operation and a display. Element 2 is a control device such as a micro processor (MPU) that controls the operation of the microwave oven. Element 3 is a power supply source which controls power supply to a microwave generating device 4 such as a magnetron as heating means for the microwave oven, a heater cooking device 5 and a blower 6 according to a control signal from the control device 2. Element 7 is temperature sensor means such as a thermistor which detects the heating chamber temperature. Element 8 is a damper that opens or closes due to the shape memory effect of a shape memory alloy. When the temperature in the heating chamber rises, the shape memory alloy resumes its memorized shape due to the heat, allowing the damper to close the blowhole provided for supplying ventilating air from the blower 6 to the heating chamber.

The function of the control device 2 related to the present invention is now described on the basis of the flow chart of FIG. 2.

It is assumed that heater cooking such as grill cooking in a non-convectional mode or hot-air circulating cooking in a convection cooking mode by an electric heater is selected. When the start key is depressed with the heater cooking mode selected and the cooking time (T) set on the control panel 1, the control device 2 such as a micro processor (MPU) outputs a signal for actuating the heater cooking device to cook food for the preset time (T). Then, the control device 2 makes the temperature sensor means detect the heating chamber temperature (K). When the temperature (K) is the same as or higher than a specified value (For example, about 100° C.), the control device 2 sets timer means TIME (countdown timer) for actuating the blower 6 with delay at 0. When the temperature (K) is below the specified value, the control device 2 sets the timer means TIME at a specified value (say 2 minutes) considered necessary for the heating chamber to be heated high enough to close the damper 8. Next, the control device 2 judges whether the setting of the timer means TIME is 0 or not, and outputs a signal for actuating the blower 6 when the setting is 0. Otherwise, it waits for the timer means TIME to count down to 0 (taking about 2 minutes) before it outputs the signal for actuating the blower 6. By this time, the damper 8 has already closed the blowhole. With this state, heater cooking operation is continued for the preset cooking time (T).

When the cooking time (T) has elapsed, the control device 2 turns OFF the heater cooking device 5 and detects the heating chamber temperature (K). When it finds the temperature (K) below the specified value (for example, about 100° C.), it outputs a signal for stopping the blower 6. When the temperature (K) is not lower than the specified value, on the other hand, the control device 2 continues detecting the heating chamber temperature (K) until the temperature (K) drops below the specified value, while allowing the blower 6 to keep operating. On detecting the temperature (K) below the specified value, the control device 2 performs the blower-stopping routine.

According to the present invention, as described above, the damper operated by the heat of the heating chamber for controlling ventilation to the heating chamber is actuated promptly and accurately at the time of starting heater cooking so that the heating chamber temperature can be raised rapidly and efficiently.

Figure 4A:
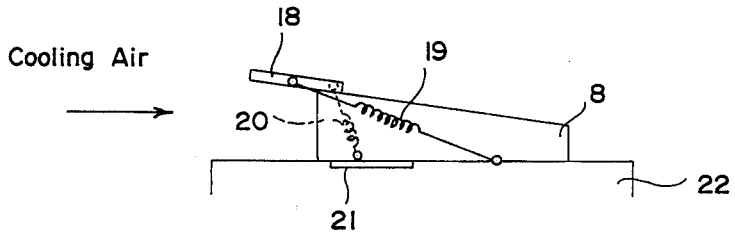
FIGS. 4(1) and 4(2) schematically show dampers of the microwave oven of the present invention which use a shape memory alloy spring.
Figure 4B:
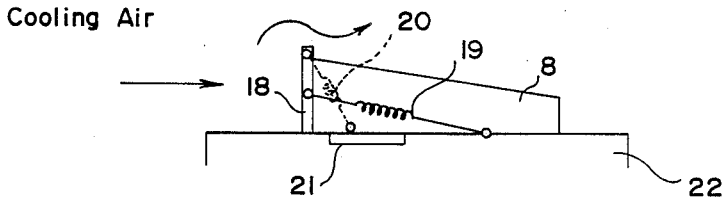
Figure 3:
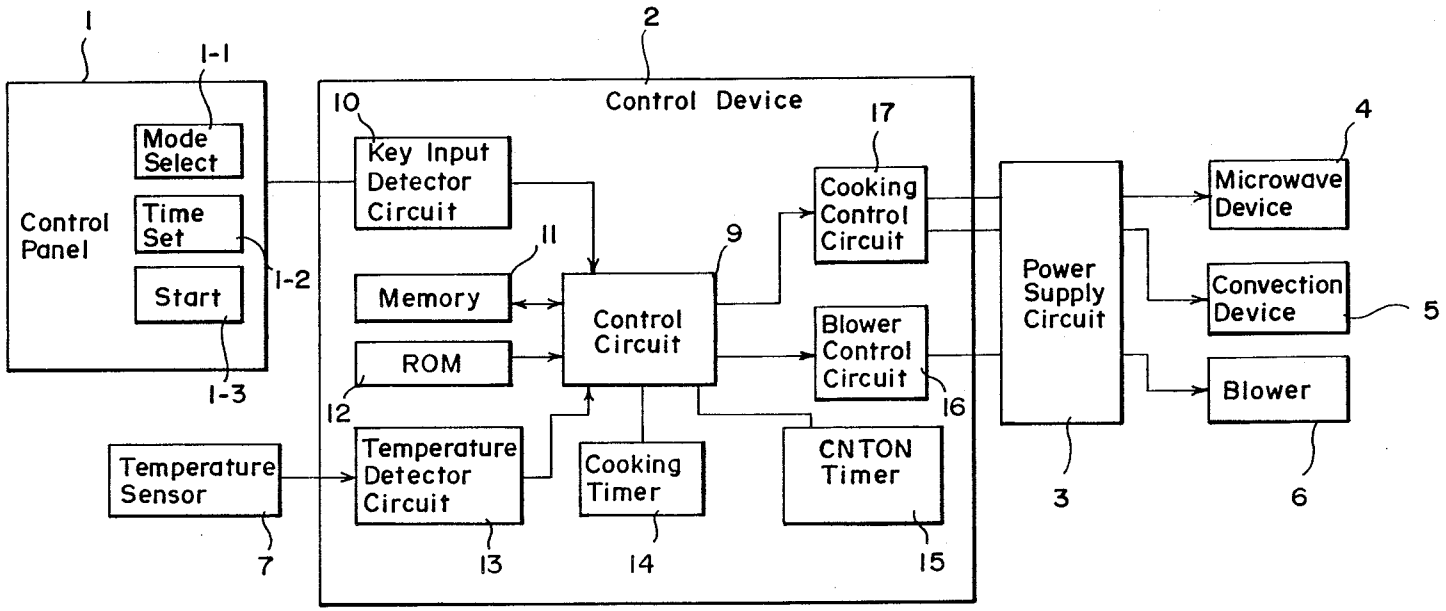
FIG. 3 is a schematic block diagram of the control device of the microwave oven of the present invention.

FIG. 3 is a block diagram showing the schematic construction of the control device 2, and FIGS. 4(1) and 4(2) show an example of the damper used in the present invention.

Referring to FIG. 3, a cooking mode selection signal input by the cooking mode selector key 1-1 on the control panel 1 is detected by a key input detector circuit 10 and stored through a control circuit 9 in a predetermined area of a memory (RAM) 11. A cooking time signal input by a cooking (heating) time setting key 1-2 is also detected by the key input detector circuit 10 and stored through the control circuit 9 in a predetermined area of the memory 11. When a cooking start signal input by a cooking start key 1-3 on the control panel 1 is detected by the key input detector circuit 10 and sent to the control circuit 9, the control circuit 9 reads the cooking mode selection signal and the cooking time signal stored in the memory 11, and sends the cooking mode selection signal to a cooking control circuit 17, and the cooking time signal to a cooking timer 14.

According to the cooking mode selection signal, the cooking control circuit 17 selects an appropriate cooking device (a microwave generating device 4 or a heater cooking device 5), and supplies power from the power supply circuit 3 to the selected cooking device.

The cooking timer 14 sets cooking time according to the cooking time signal and counts down the set cooking (heating) time. The count of the cooking timer 14 is checked by the control circuit 9. When the timer 14 has counted down to zero, the control circuit 9 outputs a control signal to the cooking control circuit 17 to stop supplying power to the cooking device concerned.

When the microwave cooking mode has been selected, the cooking control circuit 17 supplies power to the microwave generating device 4, and the control circuit 9 sends a control signal to a blower control circuit 16 to supply power from the power supply sorce 3 to the blower 6 in response to the cooking start signal input, so that the blower 6 for supplying cooling air to the cooking chamber 22 and to the microwave generating device 4 such as a magnetron is actuated simultaneously as a cooking operation is started. In the microwave cooking mode, the blower 6 is continuously operated until the cooking timer 14 has counted down to zero.

When the heater cooking mode has been selected, the control circuit 9 sends a control signal, in response to the input by the cooking start key, to the heater cooking device 5 to operate it for the preset cooking time. Also in response to the input by the cooking start key, the control circuit 9 controls the temperature detector circuit 13 so that the temperature sensor means 7 such as the thermistor detects the temperature in the cooking chamber. The cooking chamber temperature detected is sent to the control circuit 9 for comparison with a reference temperature (H) stored in advance in a memory (ROM) 12. When the cooking chamber temperature is the same as or higher than the reference temperature (H), the control circuit 9 sends a control signal to the blower control circuit 16 to actuate the blower 6. When the cooking chamber temperature is lower than the reference temperature (H), on the other hand, the control circuit 9 reads a specified time (I) stored in advance in the ROM 12 and sets it in a timer 15 for actuating the blower 6 with a delay so that the timer 15 counts down for the specified time (I). The blower 6 stops operation while the timer 15 is counting down.

When the control circuit 9 understands that the timer 15 has counted down to zero, the blower control circuit 16 actuates the blower 6. Namely, the blower 6 is fed with power from the power supply circuit 3.

When the control circuit 9 understands that the cooking timer 14 has counted the preset cooking time, the cooking control circuit 17 works to shut off power supply to the heater cooking device. At this time, the control circuit 9 outputs a control signal to the temperature detector circuit 13 so that the temperature sensor means 7 detects the cooking chamber internal temperature.

The control circuit 9 compares the detected temperature with the reference temperature (H) stored in the ROM 12. When the detected temperature is lower than the reference temperature (H), the blower control circuit 16 works to stop the blower 6, whereas if it is the same as or higher than the reference temperature (H), the blower 6 is allowed to continue operating. In the latter case, the cooking chamber internal temperature is detected and compared with the reference temperature (H) periodically, and when it is judged to be lower than the reference temperature (H), the blower control circuit 16 stops the blower 6.

Here, the reference temperature (H) stored in the ROM 12 is the temperature at which the shape memory alloy spring used in the damper shown in FIGS. 4(1) and 4(2) changes its shape due to the shape memory effect. (It is, for instance, at about 100° C.)

The specified time (I) stored in the ROM 12 is the time required for the cooking chamber internal temperature to reach the reference temperature (H). (It is, for instance, about 2 minutes.)

FIG. 4(1) shows the state of the damper in the microwave cooking mode in which a damper lid 18 need not be closed. Cooling air supplied by the blower 6 is led through the damper 8 and the blowhole 21 into the cooking chamber 22. At a normal temperature, the shape memory alloy spring 19 has a lower elasticity than the bias spring 20. During microwave cooking, since the temperature in the cooking chamber does not rise, the shape memory alloy spring 19 does not change in shape.

FIG. 4(2) shows the state of the damper in the heater cooking mode in which the damper lid 18 must be closed. When the cooking chamber internal temperature rises to or above the specified reference temperature, the shape memory alloy spring 19 changes in shape so that it provides higher elasticity than the bias spring 20, causing the damper lid 18 to be closed as shown in FIG. 4(2). The blower 6 is actuated after the damper lid 18 is closed. Therefore, cooling air is not led into the cooking chamber but cools electrical components outside the cooking chamber.

In the above embodiment, the specified time (I) stored in the ROM 12 is constant independent of the cooking chamber internal temperature. Alternatively, a time value calculated on the basis of the initial temperature in the cooking chamber may be set in the timer 15, or an appropriate specified time (I) may be selected depending upon the measurement of the cooking chamber internal temperature from among a plurality of specified times stored in advance for different cooking chamber internal temperatures in the ROM 12.

Furthermore, in the above embodiment, the damper lid is operated by means of the shape memory alloy spring. It may be operated by means of bimetal.

As described above, in the present invention, the blower is driven in response to the detection of the temperature at which the shape of the shape memory alloy spring or the bimetal used in the damper is changed. Therefore, the damper is actuated quickly and accurately by the heat of the heating chamber when the heater cooking is started.

While only certain embodiments of the present invention have been described, it will be apparent to those skilled in the art that various changes and modifications may be made therein without departing from the spirit and scope of the present invention as claimed.

What is claimed is:

1. A microwave/convection oven comprising:

a cooking chamber;

a control panel for selecting a microwave or convection mode, selecting a length of cooking time, and starting a cooking operation;

a power source for generating convection energy to the interior of said cooking chamber;

a damper member positioned within the wall of said cooking chamber, said damper member having open and closed positions to allow outside air to enter or prevent outside air from entering said cooking chamber, respectively;

blower means for selectively blowing cooling air at said damper member;

temperature sensing means for sensing the temperature at the interior of said cooking chamber;

countdown timer means for counting down a predetermined length of time in response to said power source being turned ON;

cooking timer means for monitoring a length of cooking time selected at said control panel; and control means responsive to selection of said convection cooking mode for detecting an internal temperature of said cooking chamber according to said temperature sensing means, for comparing said temperature sensing means, for comparing said detected temperature to a preset value, and for initiating said countdown timer means;

whereby said blower means blows cooling air at said damper means when said sensed temperature is greater than a predetermined value and said predetermined length of time has elapsed according to said countdown timer means.

2. A microwave/convection oven comprising:

means for selecting either a microwave cooking mode or a convection cooking mode;

a cooking chamber;

means, responsive to selection of the microwave cooking mode, for generating microwave cooking energy within said cooking chamber;

means, responsive to selection of the convection cooking mode, for generating convection cooking energy within said cooking chamber;

damper means positioned within the wall of said cooking chamber, said damper means having open and closed positions to allow cooling air to enter or to prevent cooling air from entering said cooking chamber, respectively;

blower means for selectively blowing the cooling air at said damper member and said means for generating microwave cooking energy;

temperature sensing means for sensing the interior temperature of said cooking chamber; and control means for actuating said blower means immediately if said cooking chamber temperature at the time of generating convection cooking is equal to or greater than a predetermined temperature and for actuating said blower means after a predetermined delay if said cooking chamber temperature at the time of generating convection cooking is less than the predetermined temperature, said control means continuously actuating said blower means if said microwave cooking energy is being generated.

3. The microwave/convection oven according to claim 2, wherein said damper means includes a shape memory alloy spring, whereby an increase in the temperature of the interior of the cooking chamber contracts the spring thereby causing said damper means to close and prevent cooling air from said blower means from entering said cooking chamber and enabling the cooking chamber temperature to increase at a rapid rate.

4. A microwave/convection oven comprising:

a cooking chamber;

means for selecting a microwave cooking mode;

means of selecting a convection cooking mode;

means for generating microwave cooking energy in said microwave cooking mode;

means for generating convection cooking energy in said microwave cooking mode;

a damper member positioned within the wall of said cooking chamber, said damper member having open and closed positions to allow cooling air to enter or prevent cooling air from entering said cooking chamber, respectively; and blower means for selectively blowing the cooling air at said damper member;

said damper member closing in response to an increase in temperature of the cooking chamber;

whereby said damper member remains open in said microwave cooking mode and said blower means continously blows cooling air to the interior of said cooking chamber and whereby said damper member closes in said convection cooking mode and said blower blows cooling air on the exterior of said cooking chamber.

5. The microwave/convection oven according to claim 4, further including temperature sensing means for sensing the interior temperature of said cooking chamber and timer means for counting down a predetermined length of time upon actuation of said convection cooking mode, wherein said blower means is actuated immediately if said cooking chamber temperature at the time of generating convection cooking energy is equal to or greater than a predetermined temperature and for actuating said blower means after a predetermined delay if said cooking chamber temperature at the time of generating convection cooking energy is less than the predetermined temperature.

* * * * *